US007526824B2

(12) United States Patent
Pontes

(10) Patent No.: US 7,526,824 B2
(45) Date of Patent: May 5, 2009

(54) SEAT CUSHION

(76) Inventor: Regina M. Pontes, 27 Jeffrey Rd., Arlington, MA (US) 02474

( * ) Notice: Subject to any disclaimer, the term of this patent is extended or adjusted under 35 U.S.C. 154(b) by 0 days.

(21) Appl. No.: 11/327,563

(22) Filed: Jan. 6, 2006

(65) Prior Publication Data

US 2006/0175878 A1 Aug. 10, 2006

Related U.S. Application Data

(60) Provisional application No. 60/642,313, filed on Jan. 7, 2005.

(51) Int. Cl.
*A47C 27/00* (2006.01)
*A47C 21/04* (2006.01)
*A47G 9/00* (2006.01)

(52) U.S. Cl. ..... 5/653; 5/639

(58) Field of Classification Search ..... 5/653, 5/421, 694, 639, 654, 636, 640, 645; D6/601
See application file for complete search history.

(56) References Cited

U.S. PATENT DOCUMENTS 1,677,743 A * 7/1928 Berton ..... 5/653
4,604,987 A * 8/1986 Keltner ..... 126/204
4,949,411 A * 8/1990 Tesch ..... 5/636
5,168,590 A * 12/1992 O'Sullivan ..... 5/490
5,191,665 A * 3/1993 Breedlove ..... 5/656
5,575,028 A * 11/1996 Brau et al. ..... 5/639
6,557,494 B2 5/2003 Pontes
D508,183 S * 8/2005 Lambden et al. ..... D6/601

* cited by examiner

*Primary Examiner*—Alexander Grosz
(74) *Attorney, Agent, or Firm*—Pandiscio & Pandiscio

(57) ABSTRACT

A seat cushion is disclosed for use as a display surface and as a temperature regulated seating surface, the seating cushion comprising a first flexible sheet having a first outer periphery; a second flexible sheet having a second outer periphery; and a first connector joining at least a portion of the first flexible sheet and the second flexible sheet together adjacent the first outer periphery and the second outer periphery, the first connector forming a cavity between the first flexible sheet and the second flexible sheet, and the connector forming a first opening between the first sheet and the second sheet, into the cavity wherein the first opening has a first given length, the cavity adapted to removably retain a heating or cooling device.

12 Claims, 6 Drawing Sheets

SEAT CUSHION

REFERENCE TO PENDING PRIOR PATENT APPLICATION

This patent application claims benefit of pending prior U.S. Provisional Patent Application Ser. No. 60/642,313, filed Jan. 7, 2005 by Regina M. Pontes et al. for SEAT CUSHION.

The above-identified patent application is hereby incorporated herein by reference.

FIELD OF THE INVENTION

This invention relates to cushions in general, and more particularly to heated and/or cooled seat cushions for indoor and/or outdoor use.

BACKGROUND OF THE INVENTION

For centuries, spectators of various outdoor and indoor events have endured various uncomfortable conditions including excessive heat, cold, wet, snow, uncomfortable seating and/or any combinations thereof. Therefore, such spectators will benefit from a seating cushion that may heat or cool, and deliver comfort in a unique form.

SUMMARY OF THE INVENTION

One object of the present invention is to provide a novel seat cushion.

Another object of the present invention is to provide a seat cushion which allows for the placement of a heating or cooling element.

Another object of the present invention is to provide a pocket for receiving a hand of the spectator for alternatively using the seating cushion as a novel hand-held promotional display item.

Still another object of the present invention is to provide an alternative use of the seat cushion as a hand warmer or hand coolant by providing a cavity in the seat cushion for receiving the hands.

Still another object of the present invention is to provide a seat cushion constructed of flexible materials such as a highly durable fabric.

And still another object of the present invention is to provide an alternative use of a seat cushion carrying case or bag as an additional heating and/or cooling source for a seatback surface of a stationary or portable chair by inserting the heating or cooling element into the case or bag and placing the heating or cooling element between the stationary or portable chair and the user's back.

Another object of the present invention is to present a light weight and portable heated or cooled circular seating cushion for use by individuals attending outdoor or indoor events.

Another object of the present invention is to provide a novel circular poly-filled seat cushion for added seating comfort.

Another object of the present invention is to provide a circular seat cushion which allows for the placement of a circular heating or cooling element.

Another object of the present invention is to provide a stitched pocket on the underside of the cushion for receiving a hand to alternatively use the circular seating cushion as a novel team promotional item.

Still another object of the present invention is to provide an alternative use of the circular seat cushion as a hand warmer or hand coolant by utilizing openings at opposite ends of the seat cushion for receiving the hands of the spectator.

Still another object of the present invention is to provide a circular seat cushion constructed of water-proofed fire resistant or fire retardant highly durable flexible fabric materials.

And still another object of the present invention is to provide an alternative use of the seat cushion carrying case or bag as an additional heating and/or cooling source for a stationary or portable seat backed chair by inserting a heating or cooling element into the case or bag and placing the case or bag between the chair and the user's back.

These and other objects of the present invention are addressed by the provision and use of a novel seat cushion.

In one preferred embodiment of the present invention, there is provided a seat cushion for use as a display surface and as a temperature regulated seating surface, the seat cushion comprising:

a first flexible sheet having a first outer periphery;

a second flexible sheet having a second outer periphery; and a first connector joining at least a portion of the first flexible sheet and the second flexible sheet together adjacent the first outer periphery and the second outer periphery, the first connector forming a cavity between the first flexible sheet and the second flexible sheet, and the first connector forming a first opening between the first sheet and the second sheet, into the cavity, wherein the first opening has a first given length;

a message displayed on the first flexible sheet on a first side thereof in opposition to the second flexible sheet; and a hand-sized pocket attached to the second flexible sheet on a second side thereof in opposition to the first flexible sheet;

wherein the given length of the opening into the cavity of the first flexible sheet and the second flexible sheet is configured to admit placement and withdrawal of a temperature regulating component therethrough so as to provide one of heating and cooling to the seating surface of the seat cushion; and wherein the hand-sized pocket provides a handle for waiving the seat cushion with a single hand so as to display the message on the first side of the first flexible sheet.

In another preferred embodiment of the present invention, there is provided a seat cushion system for use as a display surface and as a temperature regulated seating surface, the seat cushion system comprising:

a first flexible sheet having a first outer periphery;

a second flexible sheet having a second outer periphery; and a first connector joining at least a portion of the first flexible sheet and the second flexible sheet together adjacent the first outer periphery and the second outer periphery, the first connector forming a cavity between the first flexible sheet and the second flexible sheet, and the first connector forming a first opening into the cavity between the first sheet and the second sheet, wherein the first opening has a first given length;

a temperature regulating element configured for disposition into the cavity through the first opening;

a message displayed on the first flexible sheet on a first side thereof in opposition to the second flexible sheet; and a hand-sized pocket attached to the second flexible sheet on a second side thereof in opposition to the first flexible sheet;

wherein the given length of the opening into the cavity of the first flexible sheet and the second flexible sheet is configured to admit placement and withdrawal of a temperature regulating component therethrough so as to provide one of heating and cooling to the seating surface of the seat cushion; and wherein the hand-sized pocket provides a handle for waiving the seat cushion with a single hand so as to display the message on the first side of the first flexible sheet.

In another preferred embodiment of the present invention, there is provided a seat cushion for use as a temperature regulated seating surface, the seat cushion comprising:

a first flexible sheet having a first outer periphery;

a second flexible sheet having a second outer periphery; and a connector joining a portion of the first flexible sheet and the second flexible sheet together adjacent the first outer periphery and the second outer periphery, the connector forming a cavity between the first flexible sheet and the second flexible sheet, and the connector forming an opening between the first sheet and the second sheet, into the cavity, wherein the opening has a given length;

wherein the given length of the opening into the cavity of the first flexible sheet and the second flexible sheet is configured to admit placement and withdrawal of a temperature regulating component therethrough so as to provide one of heating and cooling to the seating surface of the seat cushion.

BRIEF DESCRIPTION OF THE DRAWINGS

The above and other objects and features of the present invention will be more fully disclosed in, or rendered obvious by, the following detailed description of the preferred embodiments of the invention, which is to be considered together with the accompanying drawings wherein like numbers refer to like parts, and further wherein.

DETAILED DESCRIPTION OF THE PREFERRED EMBODIMENT

Referring to FIGS. 1-4, in a preferred embodiment of the present invention, there is shown a seat cushion 5 having a first portion 10 and a second portion 15 permanently joined together so as to form an internal cavity 20.

Figure 3:
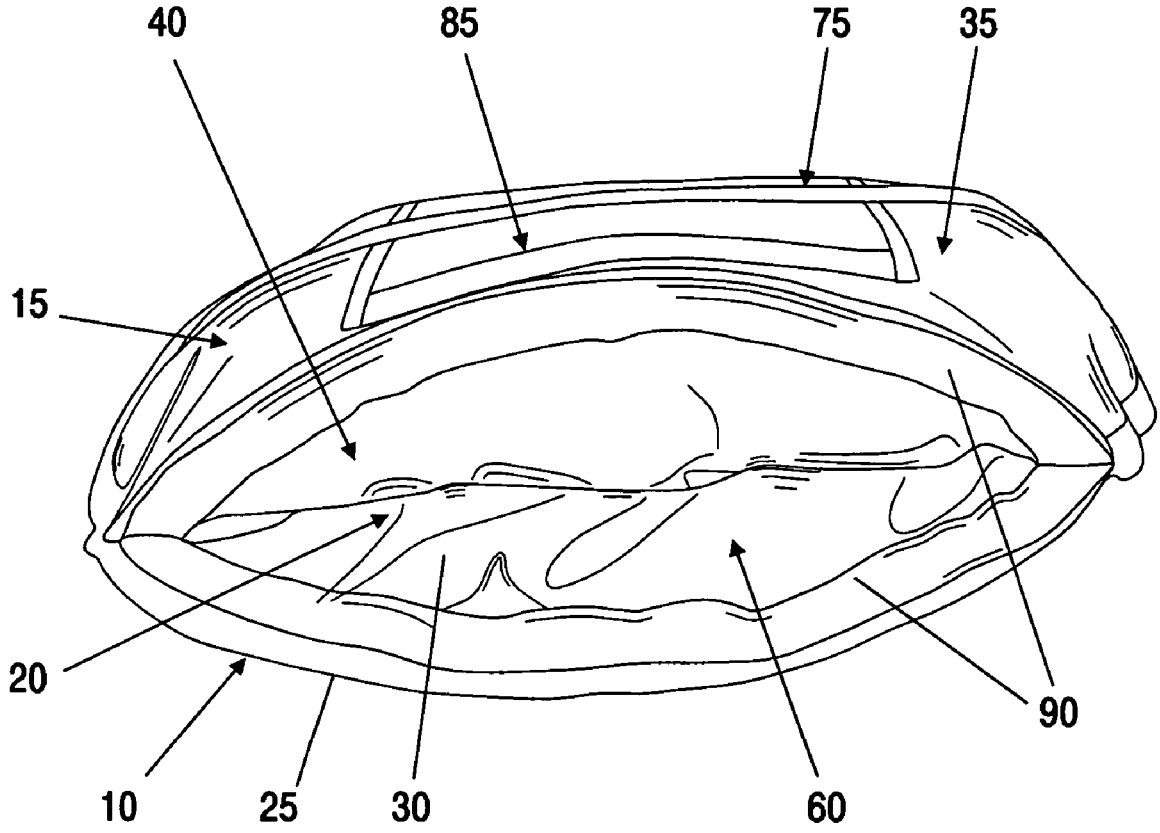
FIG. 3 is a schematic view of an internal cavity formed by permanently binding together sections of the top portion and the bottom portion of the seat cushion, with the sections being bound together so as to form a selectively openable entrance between the permanently bound sections, the selectively openable entrance including operable closure mechanisms for selectively closing off the top portion and bottom portion together when desired.

Referring now to FIG. 3, in a preferred embodiment of the present invention, first portion 10 preferably comprises a first flexible sheet 25 and a second flexible sheet 30 stitched together, with a compact poly-filled material (not shown) placed therebetween, so as to create a first soft pillow, i.e., first portion 10. Second portion 15 preferably comprises a third flexible sheet 35 and a fourth flexible sheet 40 stitched together, with a less densely-packed poly-filled material (not shown) placed therebetween, so as to create a second soft pillow, i.e., second portion 15. First portion 10 and second portion 15 are selectively connected at their perimeters so that they collectively form the seat cushion 5. More particularly, section 45A on one side of the cushion perimeter, and section 45B on the other side of the cushion perimeter, are preferably stitched together with a connector 50A and a connector 50B so as to form internal cavity 20 of seat cushion 5.

Preferably, first portion 10 and second portion 15 are each circular in shape. The diameters of first portion 10 and second portion 15 are each preferably about 16.5 inches to about 19 inches. In addition, first portion 10 and second portion 15 generally comprise waterproof and/or fire resistant or fire retardant fabric. In other preferred embodiments of the present invention, first portion 10 and second portion 15 are shaped in various forms including, but not limited to, rectangles, squares and octagons.

As shown, first portion 10 and second portion 15 are similarly sized and shaped relative to one another. In other preferred embodiments of the present invention, first portion 10 and second portion 15 are differently sized and/or shaped relative to one another.

In addition, one or both of first portion 10 and second portion 15 may include only a thin sheet of material rather than a filled pillow structure.

Figure 1:
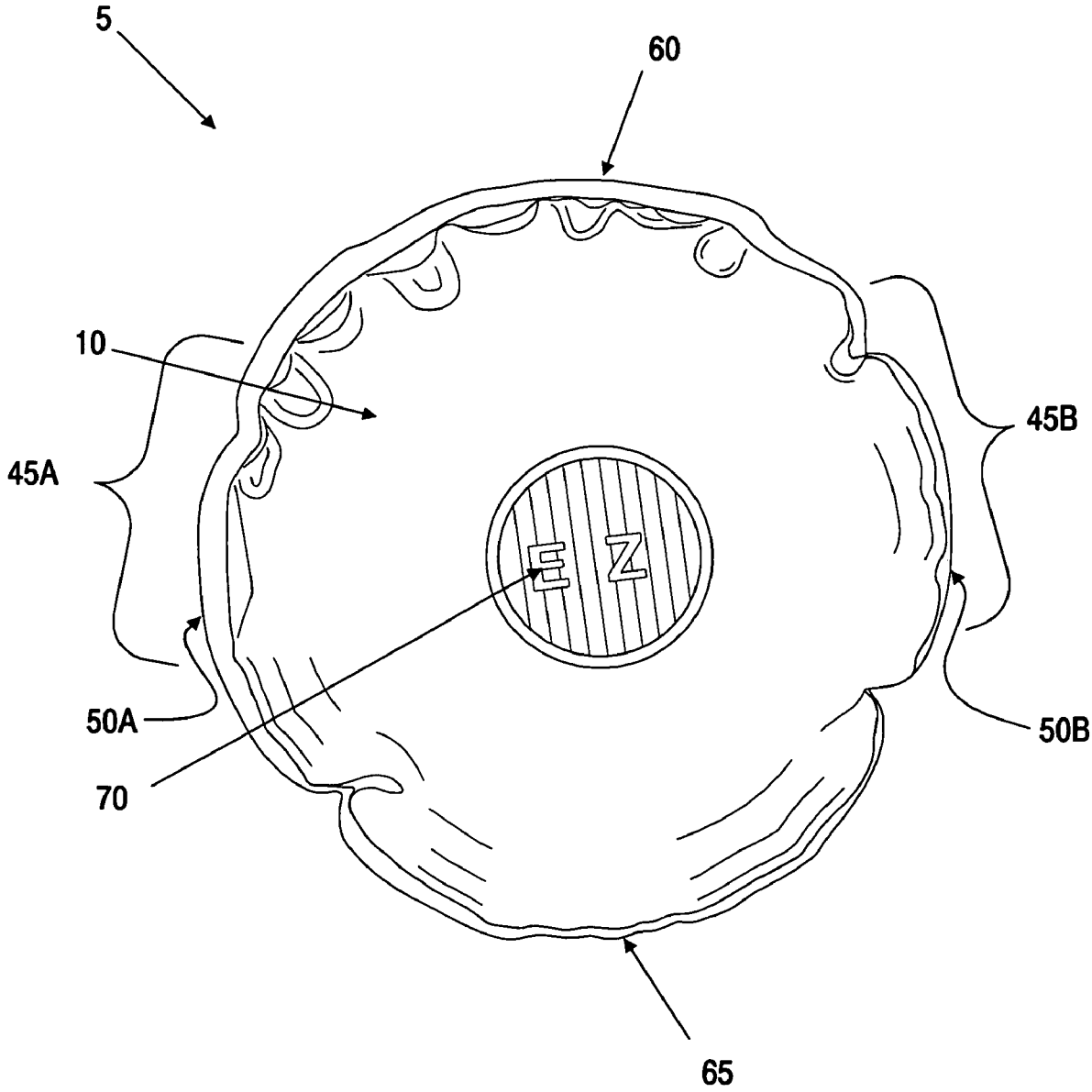
FIG. 1 is a schematic view illustrating a top portion of a seat cushion.
Figure 2:
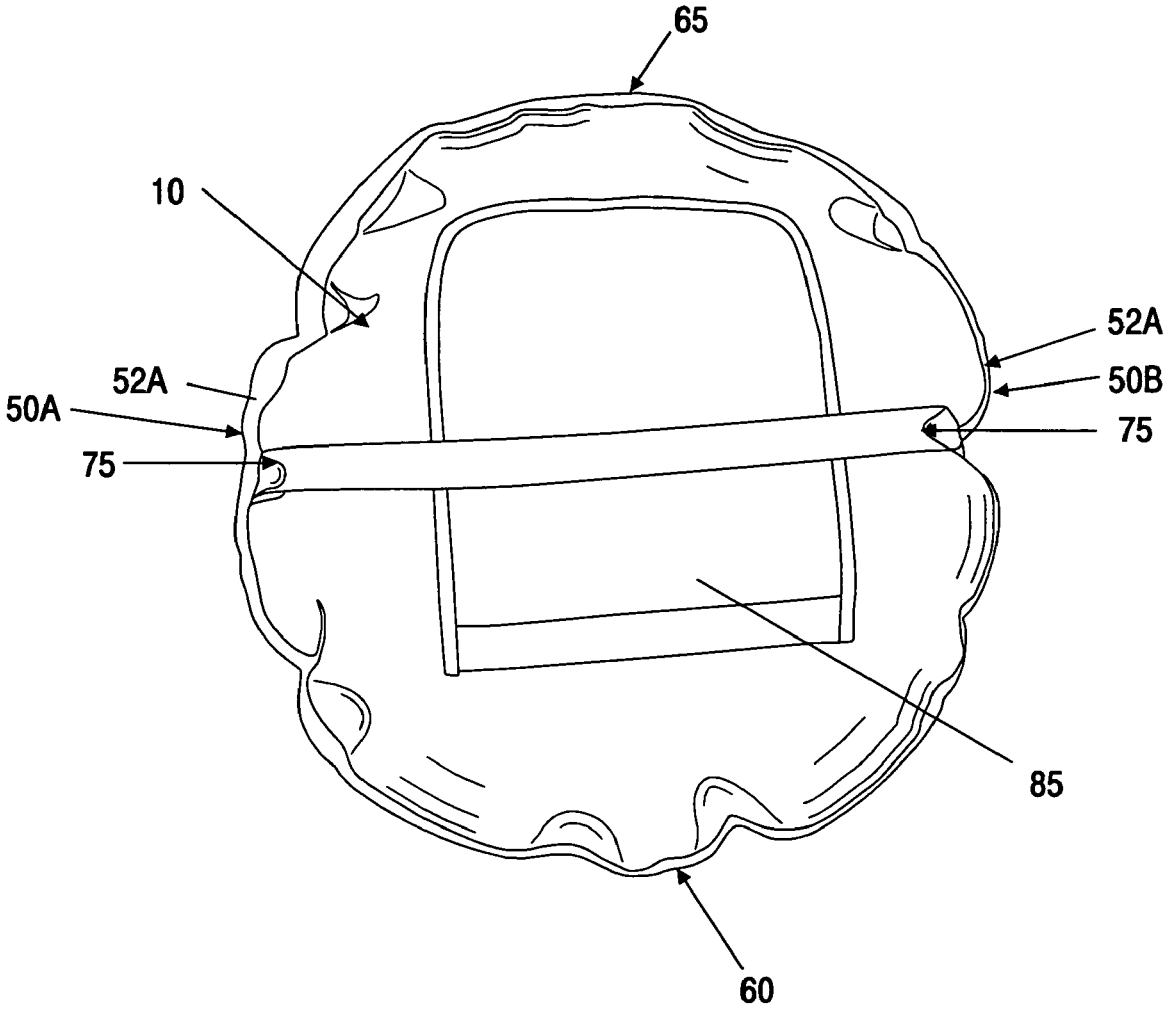
FIG. 2 is an schematic view illustrating a bottom portion of the seat cushion.

Looking now at FIGS. 1 and 2, in a preferred embodiment of the present invention, there is shown connector 50A and connector 50B joining together first portion 10 and second portion 15. Generally, connector 50A and connector 50B are placed adjacent to the perimeters of first portion 10 and second portion 15. The placement of connector 50A and connector 50B creates a cavity 20 internal to connector 50A and connector 50B, and the separations between connector 50A and 50B create a first entrance 60 (FIG. 3) and a second entrance 65 (FIG. 4).

Figure 4:
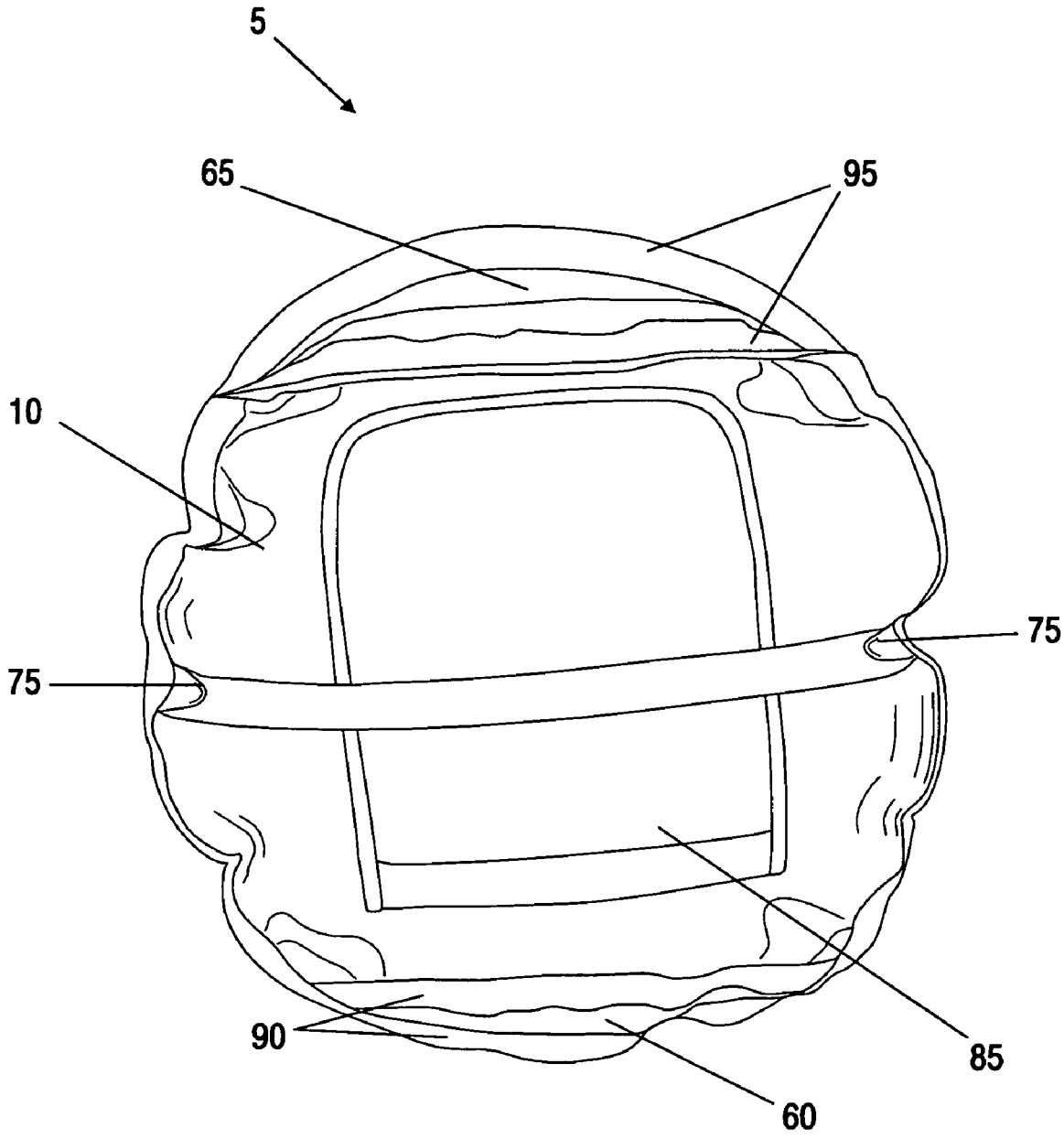
FIG. 4 is a plan view showing another larger entrance into the internal cavity, with the smaller entrance of FIG. 3 and the larger entrance exposed to reveal the closure mechanisms.

Referring now to FIGS. 3 and 4, first entrance 60 preferably has an opening of about 6 inches to 7 inches and second entrance 65 preferably has an opening of about 16 inches to 18.5 inches. First entrance 60 and second entrance 65 each lead to the interior cavity 20.

Looking now at FIGS. 1 and 2, connector 50A and connector 50B preferably include, but are not limited to, the use of thread, binding, gluing, heat sealing, riveting or other similar closure mechanisms for permanently attaching sections of first portion 10 and second portion 15 to one another. In one preferred embodiment of the present invention, connector 50A and connector 50B include a zig-zag stitch to attach first portion 10 and second portion 15 to one another. In another preferred embodiment of the present invention, connector 50A and connector 50B include heat sealing.

Referring again to FIG. 1, in a preferred embodiment of the present invention, there is shown a display message 70 disposed on the outer surface of first portion 10. Display message 70 may include a sports team logo or a promotional advertisement. Preferably, connector 50A and connector 50B are placed symmetrically and extend to a midpoint 52A and a midpoint 52B, respectively, so as to center first entrance 60 and second entrance 65 with respect to one another and provide a smaller opening in first entrance 60 than second entrance 65.

Referring again to FIG. 2, in a preferred embodiment of the present invention, there is shown an elastic stretch band 75 disposed on second portion 15 for attachment of seat cushion 5 to a seating surface. Elastic stretch band 75 preferably has fastening elements at one or both ends thereof. Preferably, elastic stretch band 75 has a width of about 1 inch and comprises a shrink-resistant braided elastic material.

Still referring to FIG. 2, there is shown an external pocket 85 disposed on second portion 15 for receiving a user's hand so as to allow vertical display of seating cushion 5 and display message 70. Pocket 85 is uniquely constructed to allow insertion of a hand into seat cushion 5 for use at sporting events as a team spirit promotional item. By way of example but not limitation, external pocket 85 may comprise, a three-sided centered stitched pocket about 6 inches wide and about 10 inches long.

Referring again to FIG. 3, in a preferred embodiment of the present invention, there is shown a closure 90 disposed on first portion 10 and second portion 15 at first entrance 60. Preferably, closure 90 allows selective opening and closing of entrance 60 so as to form an opening with a length of about 6 inches to about 7 inches. Closure 90 may be formed out of various mechanical closures of the sort known in the art for holding two pieces of fabric in selective engagement, e.g., snaps, zippers, etc.

Referring again to FIG. 4, in a preferred embodiment of the present invention, there is shown first entrance 60 and second entrance 65 in opened positions for access into internal cavity 20 (FIG. 3) of seat cushion 5. Closure 90 is disposed along the perimeter of portions 10 and portion 15 at the first entrance 60. A closure 95 is disposed on first portion 10 and portion 15 at second entrance 65. Preferably, second entrance 65 has an opening with a length of about 16 inches to about 18.5 inches. Closure 95 may be formed out of various mechanical closures of the sort known in the art for holding two pieces of fabric in selective engagement, e.g., snaps, zippers, etc.

Figure 5:
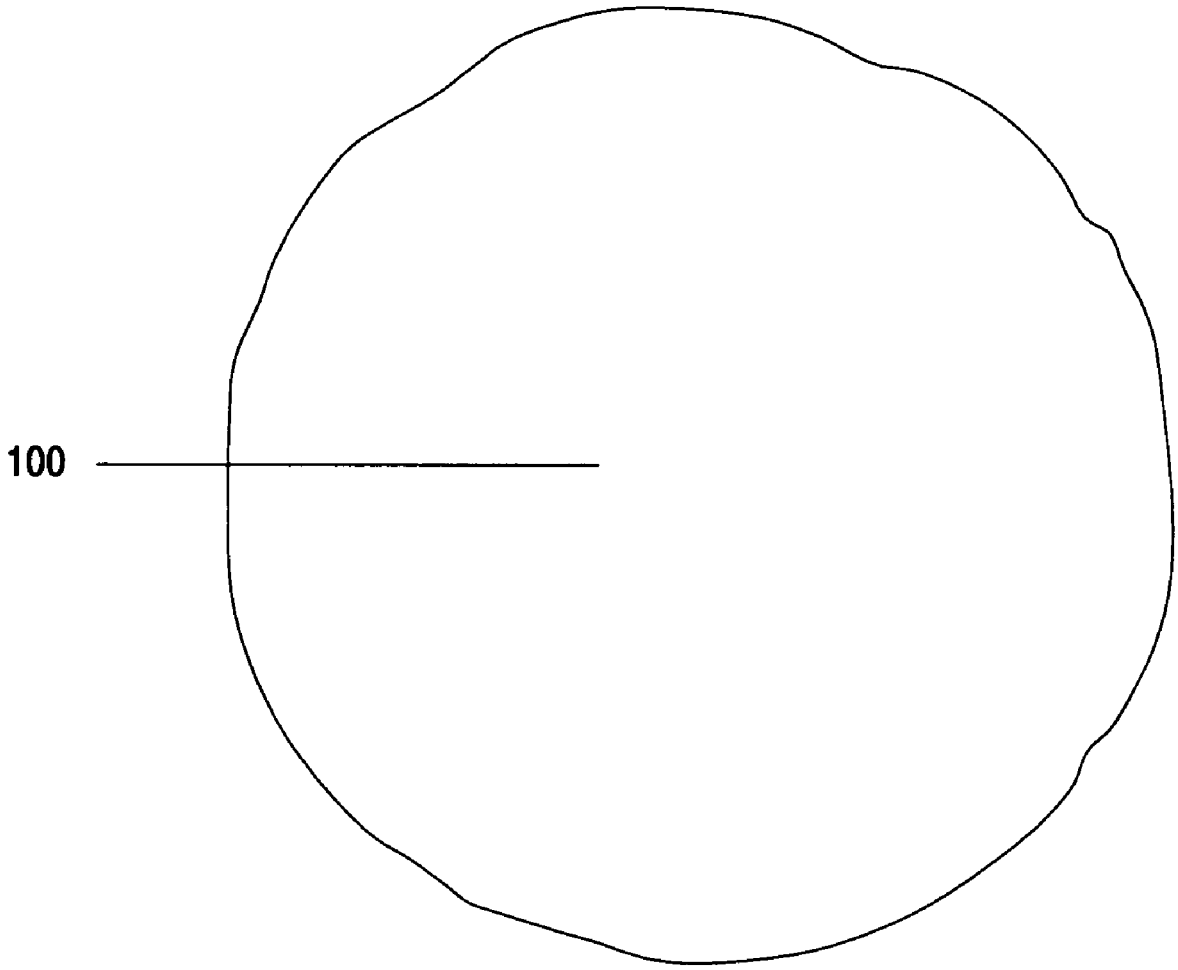
FIG. 5 is a schematic view of a heating and/or cooling element designed for insertion directly into the internal cavity of the seat cushion.

Referring now to FIG. 5, in a preferred embodiment of the present invention, there is shown an element 100 that contains either a heating component or a cooling component. Preferably, heating and/or cooling element 100 is designed to be inserted directly into cavity 20 (FIG. 3) of seat cushion 5 through first entrance 60 or second entrance 65. Element 100 contains heating or cooling chemicals that are preferably chemically activated or induced by either exposure to air or by compression initiated by the user. Element 100 is preferably about 16 inches to 18.5 inches in diameter for optimum compatibility for insertion into recess 20 (FIG. 3) of seating cushion 5. In addition to use as a passageway for placing element 100 into cavity 55, first entrance 60 or second entrance 65 allow placement of hands therethrough as to use seat cushion 5 as a hand-warming device, e.g., as a sort of "hand muff".

Figure 6:
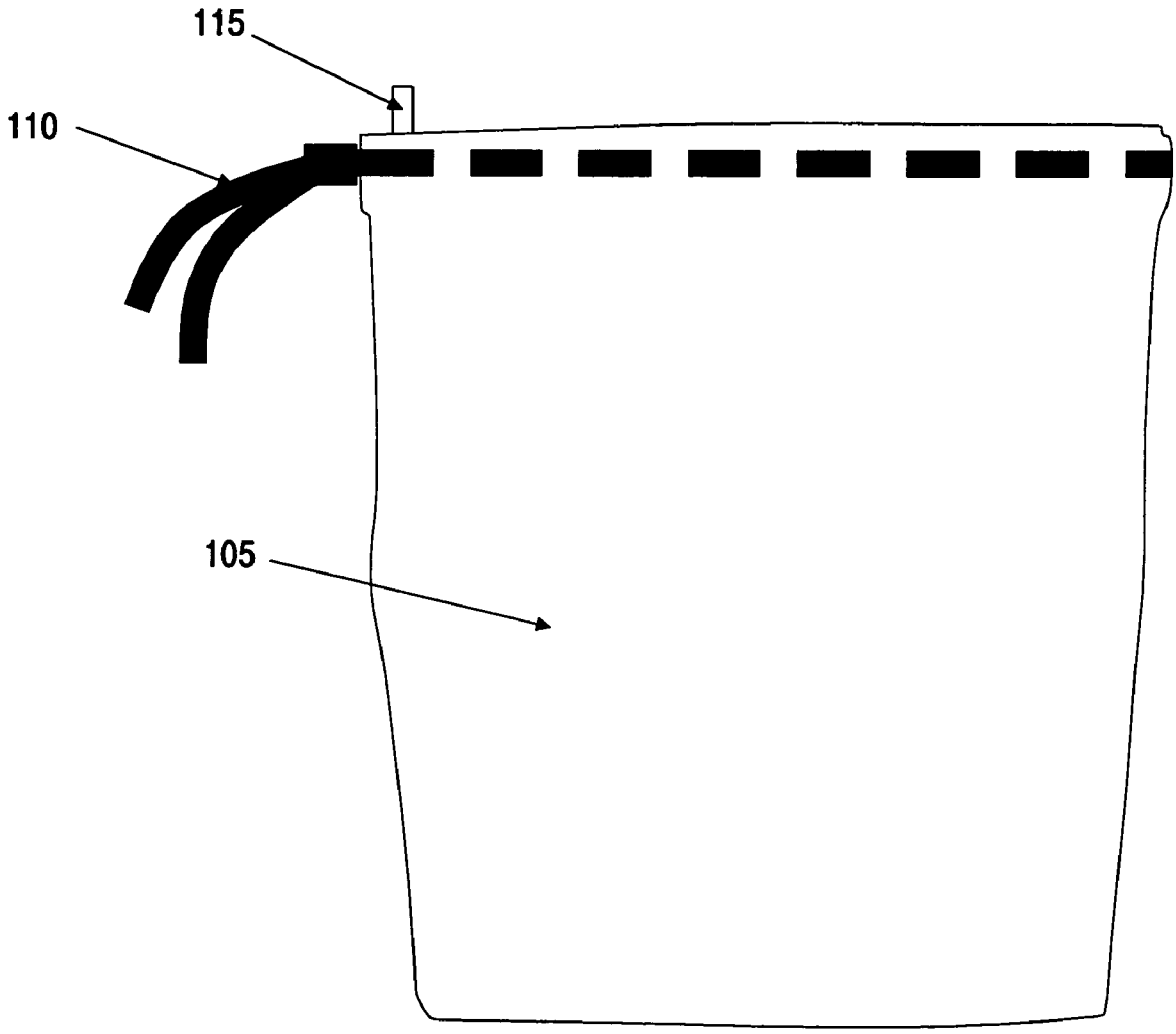
FIG. 6 displays a storage bag or carrying case for storing the seat cushion within its confines.

Referring now to FIG. 6, in a preferred embodiment of the present invention, there is shown a portable carrying case or storage bag 105 sized to hold seat cushion 5 and designed to double as a container for another heating or cooling element 100 for use on the seatback of a stationary or portable chair (not shown). Preferably, there is provided a draw string 110 that closes storage bag 105. In addition, there is shown a loop 115 for attachment of a D-ring (not shown). The D-ring is preferably an optional accessory. Generally, portable carrying bag 105 uses the same component fabric materials as seat cushion 5. Preferably, bag 105 does not to exceed a size of 16 inches by 16 inches by 3 inches.

MODIFICATIONS

It will be understood that many additional changes in the details, materials, steps and arrangements of parts, which have been herein described and illustrated in order to explain the nature of the invention, may be made by those skilled in the art while remaining within the principles and scope of the present invention.

What is claimed is:

1. A seat cushion for use as a display surface and as a temperature regulated seating surface, the seat cushion comprising:

a first flexible sheet having a first outer periphery;

a second flexible sheet having a second outer periphery;

a first connector joining at least a portion of the first flexible sheet and the second flexible sheet together adjacent the first outer periphery and the second outer periphery, the first connector forming a cavity between the first flexible sheet and the second flexible sheet, and the first connector forming a first opening between the first sheet and the second sheet, into the cavity, wherein the first opening has a first given length;

a second connector forming a second opening into the cavity, and wherein the second opening has a second given length;

a message displayed on the first flexible sheet on a first side thereof in opposition to the second flexible sheet;

a strap attached to the second flexible sheet and configured for attaching the seat cushion to a seating surface; and a hand-sized pocket having a minimum length of about six inches and a minimum width of about ten inches and attached to the second flexible sheet on a second side thereof in opposition to the first flexible sheet, wherein the hand-sized pocket is attached to the second flexible sheet with three sides sewn in a closed configuration and one side unsewn in an open configuration;

wherein the given length of the opening into the cavity of the first flexible sheet and the second flexible sheet is configured to admit placement and withdrawal of a temperature regulating component therethrough so as to provide one of heating and cooling to the seating surface of the seat cushion;

wherein the first given length of the first opening and the second given length of the second opening are sized to allow placement of a hand therethrough so as to provide for hand-waving;

wherein the first opening has a first given length in the range of about 2 inches to about 8 inches and the second opening has a second given length in the range of about 2 inches to about 18.5 inches; and wherein the hand-sized pocket provides a handle for waving the seat cushion with a single hand so as to display the message on the first side of the first flexible sheet.

2. A seat cushion according to claim 1 wherein the message is a sports team logo.

3. A seat cushion according to claim 1 wherein the message is an advertisement.

4. A seat cushion according to claim 1 wherein the strap attached to the second flexible sheet is an elastic strap.

5. A seat cushion according to claim 1 wherein the first flexible sheet has a first given diameter in the range of about 16.5 inches to about 19 inches.

6. A seat cushion according to claim 1 wherein the first opening has a first given length in the range of about 6 inches to about 7 inches.

7. A seat cushion according to claim 1 wherein the second opening has a second given length in the range of about 16 inches to about 18.5 inches.

8. A seat cushion according to claim 1 wherein the cavity is configured to selectively hold a temperature regulating element.

9. A seat cushion according to claim 1 wherein the temperature regulating element has a second given diameter in the range of about 16 inches to about 18.5 inches.

10. A seat cushion according to claim 1 wherein the first opening includes a closure mechanism so as to allow selective closure of the first opening.

11. A seat cushion system for use as a display surface and as a temperature regulated seating surface, the seat cushion system comprising:

a first flexible sheet having a first outer periphery;

a second flexible sheet having a second outer periphery;

a first connector joining at least a portion of the first flexible sheet and the second flexible sheet together adjacent the first outer periphery and the second outer periphery, the first connector forming a cavity between the first flexible sheet and the second flexible sheet, and the first connector forming a first opening into the cavity between the first sheet and the second sheet, wherein the first opening has a first given length;

a second connector forming a second opening into the cavity, and wherein the second opening has a second given length;

a temperature regulating element configured for disposition into the cavity through the first opening;

a message displayed on the first flexible sheet on a first side thereof in opposition to the second flexible sheet;

a strap attached to the second flexible sheet and configured for attaching the seat cushion to a seating surface; and a hand-sized pocket having a minimum length of about six inches and a minimum width of about ten inches and attached to the second flexible sheet on a second side thereof in opposition to the first flexible sheet, wherein the hand-sized pocket is attached to the second flexible sheet with three sides sewn in a closed configuration and one side unsewn in an open configuration;

wherein the given length of the opening into the cavity of the first flexible sheet and the second flexible sheet is configured to admit placement and withdrawal of a temperature regulating component therethrough so as to provide one of heating and cooling to the seating surface of the seat cushion;

wherein the first given length of the first opening and the second given length of the second opening are sized to allow placement of a hand therethrough so as to provide for hand-waving;

wherein the first opening has a first given length in the range of about 2 inches to about 8 inches and the second opening has a second given length in the range of about 2 inches to about 18.5 inches; and wherein the hand-sized pocket provides a handle for waving the seat cushion with a single hand so as to display the message on the first side of the first flexible sheet.

12. A seat cushion for use as a temperature regulated seating surface, the seat cushion comprising:

a first flexible sheet having a first outer periphery;

a second flexible sheet having a second outer periphery;

a first connector joining a portion of the first flexible sheet and the second flexible sheet together adjacent the first outer periphery and the second outer periphery, the first connector forming a cavity between the first flexible sheet and the second flexible sheet, and the first connector forming an opening between the first sheet and the second sheet, into the cavity, wherein the opening has a given length;

a second connector forming a second opening into the cavity, and wherein the second opening has a second given length;

a strap attached to the second flexible sheet and configured for attaching the seat cushion to a seating surface; and a hand-sized pocket having a minimum length of about six inches and a minimum width of about ten inches and attached to the second flexible sheet on a second side thereof in opposition to the first flexible sheet, wherein the hand-sized pocket is attached to the second flexible sheet with three sides sewn in a closed configuration and one side unsewn in an open configuration;

wherein the given length of the opening into the cavity of the first flexible sheet and the second flexible sheet is configured to admit placement and withdrawal of a temperature regulating component therethrough so as to provide one of heating and cooling to the seating surface of the seat cushion;

wherein the first given length of the first opening and the second given length of the second opening are sized to allow placement of a hand therethrough so as to provide for hand-waving; and wherein the first opening has a first given length in the range of about 2 inches to about 8 inches and the second opening has a second given length in the range of about 2 inches to about 18.5 inches.

* * * * *